US005943793A

United States Patent [19]

Clements

[11] Patent Number: 5,943,793

[45] Date of Patent: Aug. 31, 1999

[54] SHOE OR BOOT WITH ADJUSTABLE ANKLE COLLAR

[75] Inventor: Jackie N. Clements, Morganton, N.C.

[73] Assignee: Columbia Insurance Company, Omaha, Nebr.

[21] Appl. No.: 09/089,281

[22] Filed: Jun. 2, 1998

[51] Int. Cl.[6] ..... A43B 7/20; A43C 11/00

[52] U.S. Cl. ..... 36/89; 36/50.1; 36/54

[58] Field of Search ..... 36/58.5, 50.1, 36/89, 54

[56] References Cited

U.S. PATENT DOCUMENTS

| | | |
|---|---|---|
| 1,472,415 | 10/1923 | Haggerty . |
| 1,545,623 | 7/1925 | Westfall . |
| 2,531,763 | 11/1950 | Andre . |
| 2,563,763 | 8/1951 | Vietas . |
| 4,621,648 | 11/1986 | Ivany . |
| 4,776,111 | 10/1988 | Crowley . |
| 4,922,630 | 5/1990 | Robinson . |
| 5,072,529 | 12/1991 | Graf . |
| 5,109,613 | 5/1992 | Van Dyke . |
| 5,177,884 | 1/1993 | Rullier . |
| 5,243,772 | 9/1993 | Francis et al. . |
| 5,319,869 | 6/1994 | McDonald et al. . |
| 5,377,430 | 1/1995 | Hatfield et al. . |
| 5,400,529 | 3/1995 | Bell et al. . |
| 5,430,960 | 7/1995 | Richardson . |
| 5,678,330 | 10/1997 | Van Dyke et al. . |
| 5,692,319 | 12/1997 | Parker et al. . |
| 5,771,608 | 6/1998 | Peterson . |

*Primary Examiner*—Ted Kavanaugh
*Attorney, Agent, or Firm*—Fish & Richardson P.C.

[57] ABSTRACT

A shoe or boot includes an ankle support collar attached to an inside surface of an upper (e.g., via stitching along a lower portion of the ankle support collar) and is formed of a resilient and flexible material to allow engagement to ankle portions of the wearer. A collar band surrounds a posterior portion of the ankle support collar and has end regions extending over the instep region of the upper. The shoe or boot is of the type having an upper attached to the sole which together define a volume for receiving the wearer's foot. The upper further defines an open instep region including at least two lacing attachments (e.g., loops such as "D"-rings) disposed along the instep portion of the upper. The shoe or boot also includes lacing which passes through the two lacing attachments and end regions of the collar band to allow tightening of the upper around the wearer's foot and the ankle support collar around the ankle portions of the wearer.

12 Claims, 3 Drawing Sheets

SHOE OR BOOT WITH ADJUSTABLE ANKLE COLLAR

BACKGROUND OF THE INVENTION

The invention relates to footwear.

Footwear including shoes and boots is typically constructed of an upper attached to a sole. The upper generally defines the volume which accommodates the wearer's foot. To secure the wearer's foot within the footwear, the upper is often tightened around the foot using a cord or string laced along an instep portion of the shoe. With boots, a portion of the upper typically extends up a substantial length of the leg to support the wearer's ankle joint. With most boots, the upper is tightened around the ankle by extending the lacing from the instep region to the ankle region.

SUMMARY OF THE INVENTION

In one aspect of the invention, a shoe or boot includes an ankle support collar attached to an inside surface of an upper (e.g., via stitching along a lower portion of the ankle support collar) and is formed of a resilient and flexible material to allow engagement to ankle portions of the wearer. A collar band surrounds a posterior portion of the ankle support collar and has end regions extending over the instep region of the upper. The shoe or boot is of the type having an upper attached to the sole which together define a volume for receiving the wearer's foot. The upper further defines an open instep region including at least two lacing attachments (e.g., loops such as "D"-rings) disposed along the instep portion of the upper. The shoe or boot also includes lacing which passes through the two lacing attachments and end regions of the collar band to allow tightening of the upper around the wearer's foot and the ankle support collar around the ankle portions of the wearer.

Embodiments of this aspect of the invention may include one or more of the following features. Each of the end regions of the collar band has a collar lacing attachment (e.g., a loop such as a "D"-ring) through which the lacing is drawn. The collar band is attached to a posterior portion of the ankle support collar and/or a left and right portions of upper surrounding the wearer's ankle, with the end regions extending to the anterior portion of the ankle support collar. Attachment of the collar band is provided, for example, by passing the collar band through the outer wall of the posterior portion of the ankle support collar and/or passing the collar band through an outer wall of a right and left portions of the upper surrounding the wearer's ankle.

By incorporating a cushioned floating ankle collar into a shoe or boot and providing a collar band that wraps around the collar, the wearer can tighten the shoe or boot around the ankle independent from tightening the upper around the instep region of the wearer's foot. In addition, the floating ankle collar can be made of a substantially softer material than the upper, which may be desired to be formed of a stiffer, more durable material. Thus, the ankle collar provides increased comfort to the wearer. The shoe or boot of the invention also includes a single lacing that passes along the instep region of the upper and through the ends of the collar band, thereby facilitating adjustment of the ankle collar without the use of auxiliary braces or other devices which can sacrifice the aesthetic appeal of the shoe or boot.

Other advantages and features of the invention will become apparent from the following detailed description and from the claims.

DETAILED DESCRIPTION

Figure 1A:
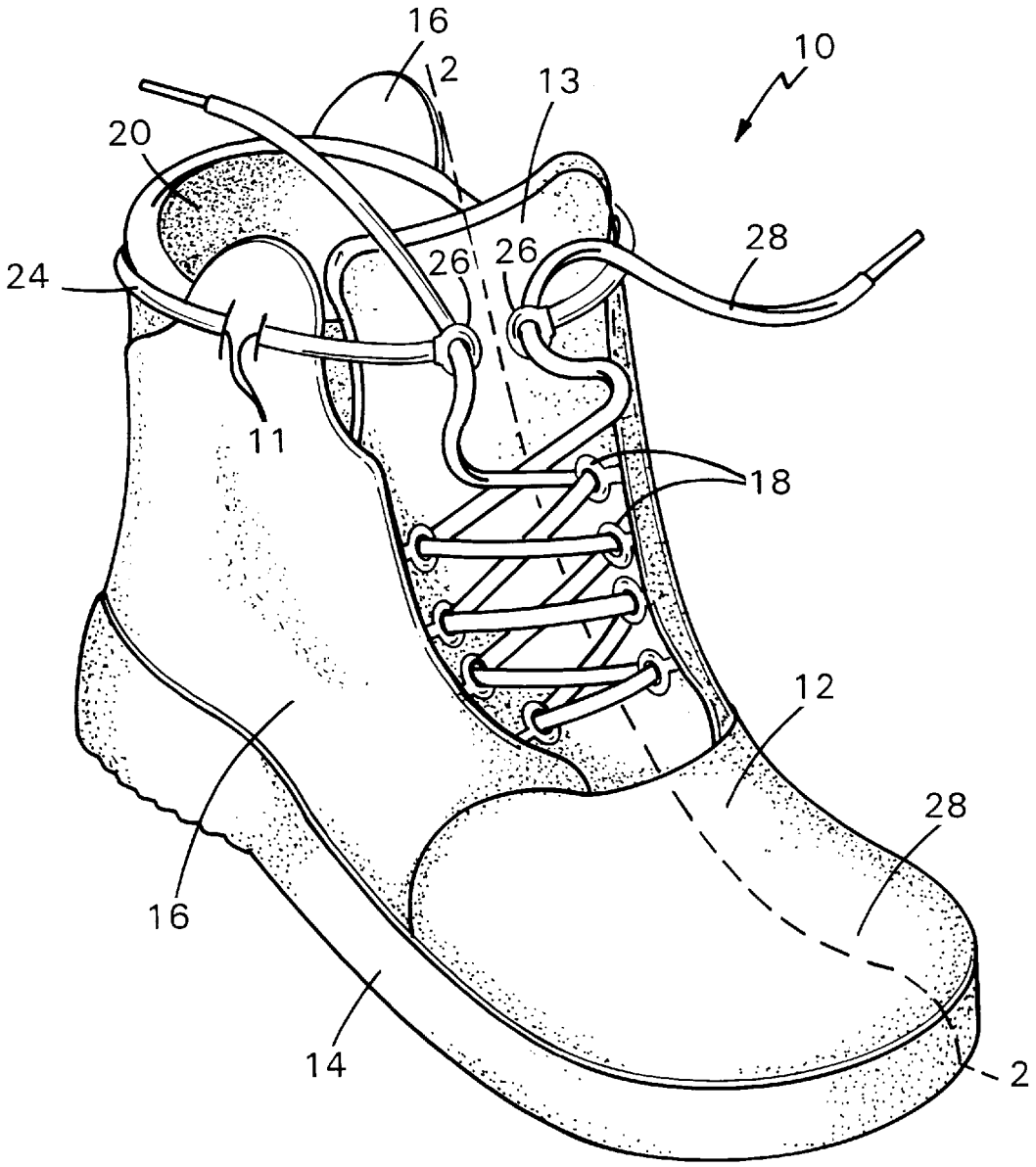
FIG. 1A is a perspective view of a boot of the invention.
Figure 1B:
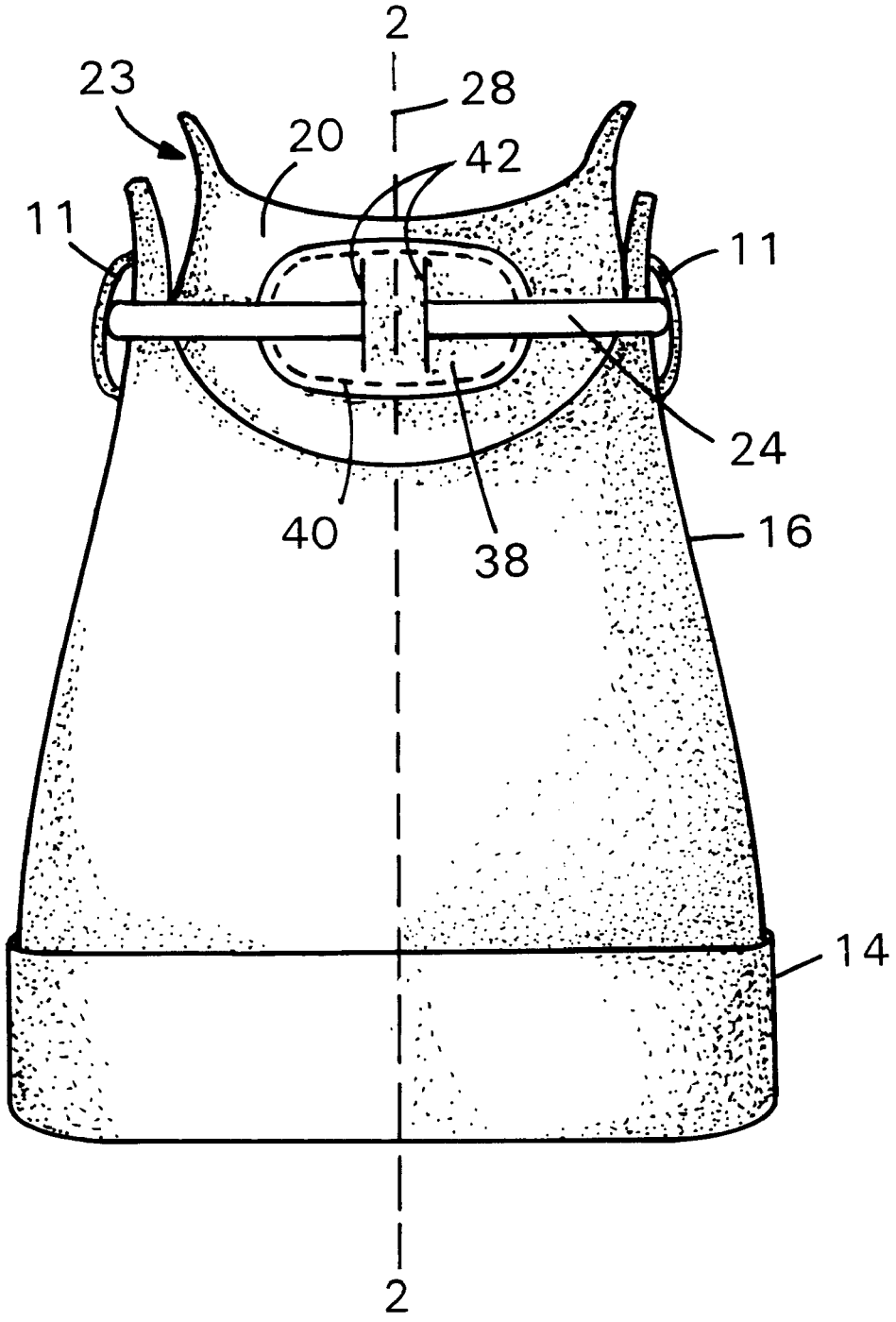
FIG. 1B is a posterior view of the boot of FIG. 1A.

Referring to FIGS. 1A and 1B, a boot 10 includes a leather upper 12 stitched to a rubber sole 14. Upper 12 includes leather quarters 16 which extend upwardly along the ankle region of upper 12 and lacing attachments 18 disposed along opposite sides into the instep region of upper 12. Pairs of slits 11 are formed in the outer wall of left and right portions of quarters 16 for attachment of a leather collar band 24. Upper 12 also includes a cushioned tongue 13 which spans the instep region. A inner cloth lining 15 (see FIG. 2) along the inner wall of upper 12 provides comfort to the wearer and/or absorbs perspiration. Cloth lining 15 can be made from any suitable material such as polyester.

Figure 2:
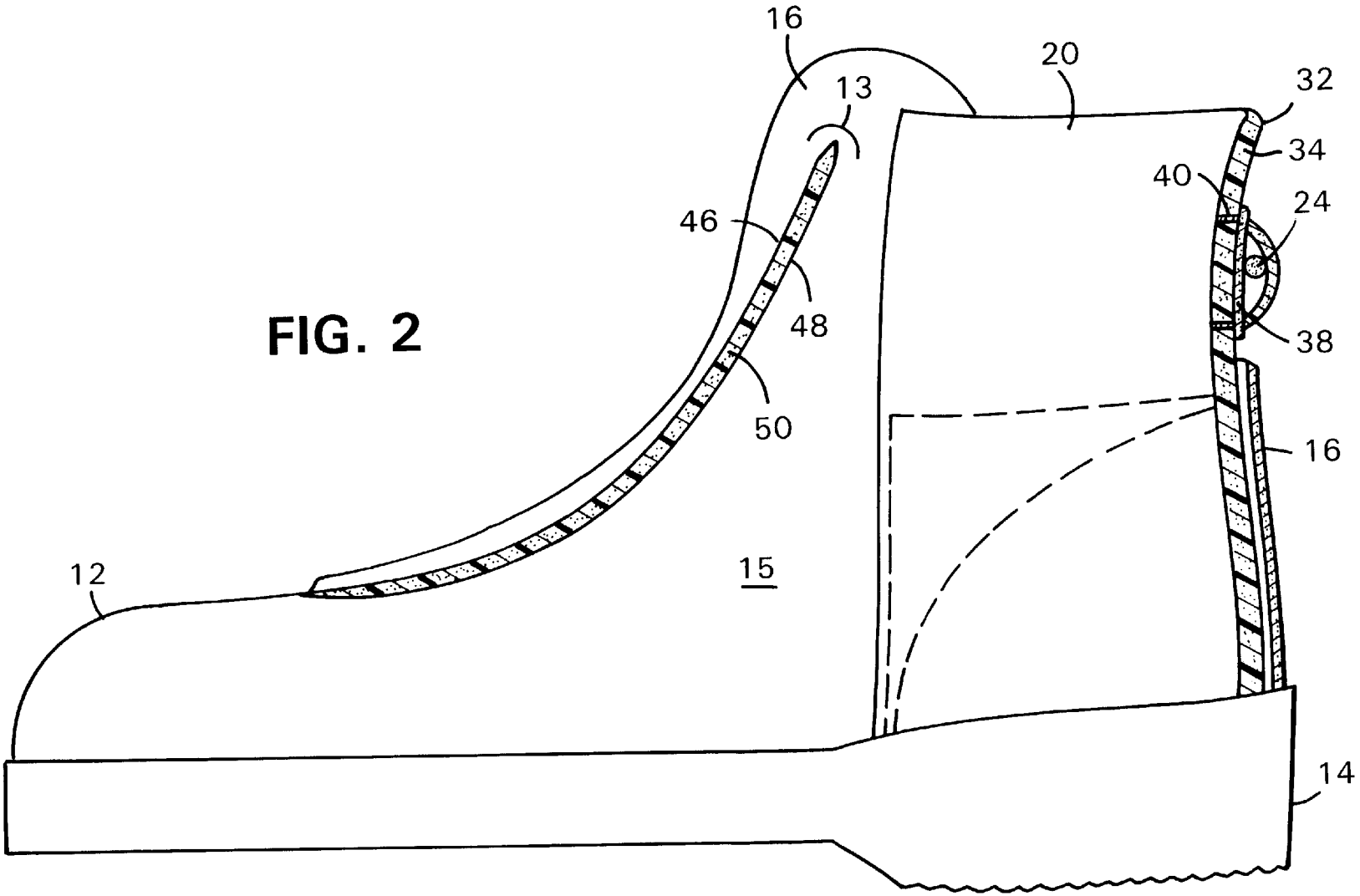
FIG. 2 as a lengthwise cross-section of the boot of FIGS. 1A and 1B along line 2—2. The lacing and lacing attachments along the instep region of the upper have been removed.

A soft cushioned ankle support collar 20 surrounds the wearer's ankle (not shown) and is attached to inner lining 15 with stitching 22 (see FIG. 2). A leather patch 38 is sewn to a posterior portion 23 of ankle support collar 20 and includes a pair of slits 42 for attachment of leather collar band 24.

A collar band 24 passes through slits 42 in leather patch 38 and slits 11 of quarters 16. Collar band 24 is made of a strong, relatively pliable material (e.g., leather). Each end of collar band 24 terminates in a collar band lacing "D"-ring 26. Lace 28 passes through lacing "D"-rings 18 along the instep region of upper 12 and both collar lacing "D"-rings 26.

To appreciate the advantages of ankle support collar 20 and collar band 24 its operation will now be described.

In general, when the boot is worn, tieing the lacing in a conventional manner results in tightening of ankle support collar 20 around the wearer's ankle via the tension transmitted along collar band 24. The wearer, however, can adjust the degree of tightness around the ankle provided by support collar 20 independent from the tightness of the instep region of upper 12, by tugging at collar band 24 with his fingers.

Referring to FIG. 2, a cross-section of the boot in FIGS. 1A and 1B along line 28 is shown. Ankle support collar 20 includes cushioning layer 34 formed of, for example, foam, and positioned between a polyester inner lining 30 and vinyl layer 32. Stitching 22 secures a lower portion of ankle support collar 20 to quarter 16. Along the posterior portion of boot 10, support for the ankle is fully provided by ankle support collar 20 since quarter 16 extends below the ankle joint. Because the upper portion of angle support collar 20 is not attached to upper 12, this portion of ankle support collar 20 provides flexibility of movement to the wearer when boot 10 is worn and ankle support collar 20 is tightened around the wearer's ankle.

Like ankle support collar 20, tongue 13 includes a cushioning layer 50 enclosed by an outer leather layer 46 and an inner polyester layer 48. Thus, when boot 10 is worn, the wearer's foot and ankle is fully surrounded by a soft cloth surface rather than a hard leather surface. In addition, the wearer's ankle tightly engages soft, cushioned ankle support collar 20 which provides both support and freedom of movement.

Other embodiments are within the following claims. For example, the lacing attachments along the instep region of the upper or at the ends of the collar band can be hooks rather than "D"-rings.

Referring to FIG. 1B, leather patch 38 is optional. Without patch 38, collar band 24 can alternatively pass through the outer wall of the ankle support collar, be chiseled directly into the posterior portion of the ankle support collar, or not be attached to the ankle support collar at all.

What is claimed is:

1. A shoe or boot comprising:

a sole;

an upper attached to the sole, the sole and upper together defining a volume for receiving a wearer's foot, the upper further defining an open instep region including a plurality of lacing attachments disposed along the instep portion of the upper;

an ankle support collar attached to an inside surface of the upper and formed of a resilient and flexible material, the ankle support collar configured to surround a wearer's ankle;

a collar band surrounding a posterior portion of the ankle support collar and having end regions extending over the instep region of the upper, the collar band configured to tighten the ankle support collar around the wearer's ankle; and a lacing passing through the plurality of lacing attachments and end regions of the collar band, the lacing configured to allow tightening of the upper around the wearer's foot and the ankle support collar around the wearer's ankle.

2. The shoe or boot of claim 1, wherein each of the end regions of the collar band has a collar lacing attachment.

3. The shoe or boot of claim 2, wherein the collar lacing attachment is a loop.

4. The shoe or boot of claim 3, wherein the collar lacing attachment is a "D"-ring.

5. The shoe or boot of claim 1, wherein the collar band is attached and movable with respect to a posterior portion of the ankle support collar.

6. The shoe or boot of claim 5, wherein the collar band passes through the outer wall of the posterior portion of the ankle support collar.

7. The shoe or boot of claim 1, wherein the plurality of lacing attachments disposed along the instep portion of the upper are loops.

8. The shoe or boot of claim 7, wherein the plurality of lacing attachments disposed along the instep portion of the upper are "D"-rings.

9. The shoe or boot of claim 1, wherein the ankle support collar is attached to the inside surface of the upper by stitching along a lower portion of the ankle support collar.

10. The shoe or boot of claim 1, wherein the collar band is attached to a right and left portion of the upper surrounding the wearer's ankle.

11. The shoe or boot of claim 10, wherein the collar band passes through the outer wall of the right and left portion of the upper surrounding the wearer's ankle.

12. A shoe or boot comprising:

a sole;

an upper attached to the sole, the sole and upper together defining a volume for receiving a wearer's foot, the upper further defining an open instep region including a plurality of instep lacing loops disposed along the instep portion of the upper;

an ankle support collar having a lower portion thereof stitched to an inside surface of the upper and formed of a resilient and flexible material, the ankle support collar configured to surround a wearer's ankle;

a collar band passing through the outer wall of a posterior portion of the ankle support collar and the outer wall of a left and right portion of the upper surrounding the wearer's ankle, the collar band having end regions extending over the instep region of the upper, each end region having a collar lacing loop, and the collar band configured to tighten the ankle support collar around the wearer's ankle; and a lacing passing through the plurality of instep lacing loops and the collar lacing loops, the lacing configured to allow tightening of the upper around the wearer's foot and the ankle support collar around the wearer's ankle.

* * * * *